US006116603A

United States Patent [19]

Huang

[11] Patent Number: 6,116,603

[45] Date of Patent: Sep. 12, 2000

[54] APPARATUS AND METHOD OF PLAYING A MATH CAPTURING AND RECAPTURING GAME

[76] Inventor: Pingsheng Huang, 20 Alpine Rd., Towaco, N.J. 07082

[21] Appl. No.: 09/227,805

[22] Filed: Jan. 11, 1999

[51] Int. Cl.[7] ..... A63F 3/00

[52] U.S. Cl. ..... 273/269; 434/208; 434/209; 273/272; 273/146

[58] Field of Search ..... 273/273, 146, 273/269, 271; 434/208, 209

[56] References Cited

U.S. PATENT DOCUMENTS

| | | |
|---|---|---|
| 898,587 | 9/1908 | Matthias . |
| 2,871,581 | 2/1959 | Guzak . |
| 5,688,126 | 11/1997 | Merritt . |

*Primary Examiner*—William M. Pierce

[57] ABSTRACT

A multiplication capturing and recapturing game system is disclosed. The system comprises 2 equilateral-triangular game boards, a pair of eight-sided dice and 36 playing pieces. The game can be played by 2 to 4 players. Each player throws two dice to begin a turn and captures or recaptures a location to end the turn. The player who finishes all 9 pieces first wins the game.

1 Claim, 3 Drawing Sheets

APPARATUS AND METHOD OF PLAYING A MATH CAPTURING AND RECAPTURING GAME

BACKGROUND

1. Field of Invention

This invention relates to a math game system, comprising 36 playing pieces, two game boards and two 8-number dices.

2. Description of Prior Art

Multiplication table (row/column multiplication method) has been used to memorize and teach math beginners for multiplication application Rows and columns can be arranged from 9 to 13 in a full square table, e.g. only 9 numbers from 1 to 9 is used in China and in the United States the numbers are from 0 to 12.

Math educators of elementary school put great emphasis on teaching and memorizing the multiplication table. The multiplication table is everywhere, on books, note-books, exercise-books, pencil boxes, rulers, even erasers. Its popularity indicates a great importance of this table on the one hand, but shows us the extreme difficulty in memorizing on the other hand. Multiplication game boards have been created with attempts to raise learning interest. Such educational devices include those disclosed by U.S. Pat. Nos. 2,871,581 to Guzak, 5,688,126 to Merritt, and 898,587 to Matthias. All the above three game boards provide an entertaining environment to raise learning interest, but fail qualitatively and quantitatively to provide devices that promise higher productivity after playing. The physical structure of these game boards make it impossible to become educational devices to be memorized as a whole and to reduce the degree of difficulty in applications of understanding and memorizing.

The original table is rough and ready, but the process of teaching and memorizing is time consuming. Without persistence, users find it difficult to use it fully and freely. In addition, it is only used for the purpose of multiplication. Other forms of applications are either neglected or not discovered. The popular table would have been more beneficial and entertaining had the simplification and more functional applications been discovered.

A regular dice has six planes with 6 numbers from 1 to 6 or 6 sets of dots representing the numbers from 1 to 6. The 6-number dice is mostly use for entering or gambling. Its interesting form has made many of entertaining games possible and playable. In other words, its great potentiality has not been discovered, let alone being put into more healthy practices, such as education or entertainment for education.

Therefore, there is a great need for redefining and simplifying the regular multiplication table and improving the 6-number dice. There has further been a great need for discovering their potentials and wonders for the benefit of education and entertainment for education. There also has been a need to improve the quality of our life in any process of learning with achievement and enjoyment.

SUMMARY OF THE INVENTION

The present invention has been in consideration of the above described problems and needs. The disclosed game system involves highly academic and entertaining competition and may be played by a group of 2, 3, 4 people. The preferred number of players is 4 people or less as the following embodiment is configured for 4 players.

According to one aspect of the invention, the disclosed game system comprises 36 playing pieces, 2 game boards (simplified multiplication table), and 2 eight-sided dice (numbers from 2 to 9). The playing pieces are usually tiles. The game can be played by 2 to 4 players, each player having 9 pieces to be put on board to win. Players take turn to roll the two dice and put a tile on the board, e.g. if the dice read 5 and 7 respectively, a tile is to be located on 35. Players are allowed to capture a vacant or recapturing an occupied location. The first player to finish putting all 9 pieces on board wins the game.

Therefore an important object of the present invention is to provide a math entertaining instrument for kids who know some basics of addition and subtraction.

It is another object of the present invention to provide a complete math game to stimulate beginners to learn the concepts of multiplication and division besides addition and subtraction.

It is still another object of the present invention to provide an entertaining game environment to familiarize kids with the powerful construction of the simplified table.

It is still another object of the present invention to provide an entertaining game environment for kids to form a mental-training habit to use the simplified table fully and freely in their academic and daily life.

Other objects, together with the foregoing are attained in the exercise of the invention in the following description and resulting in the embodiment illustrated in the accompanying drawing.

DRAWING FIGURES

DESCRIPTION—FIGS. 1 to 6

Figure 1:
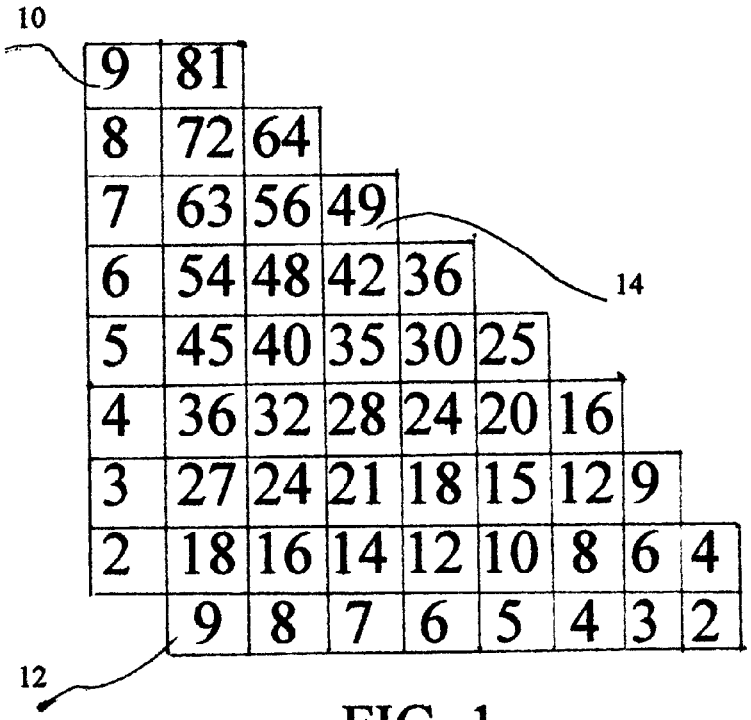
FIG. 1 shows a perspective view of a simplified multiplication table served as a game board in the game system.
Figure 2:
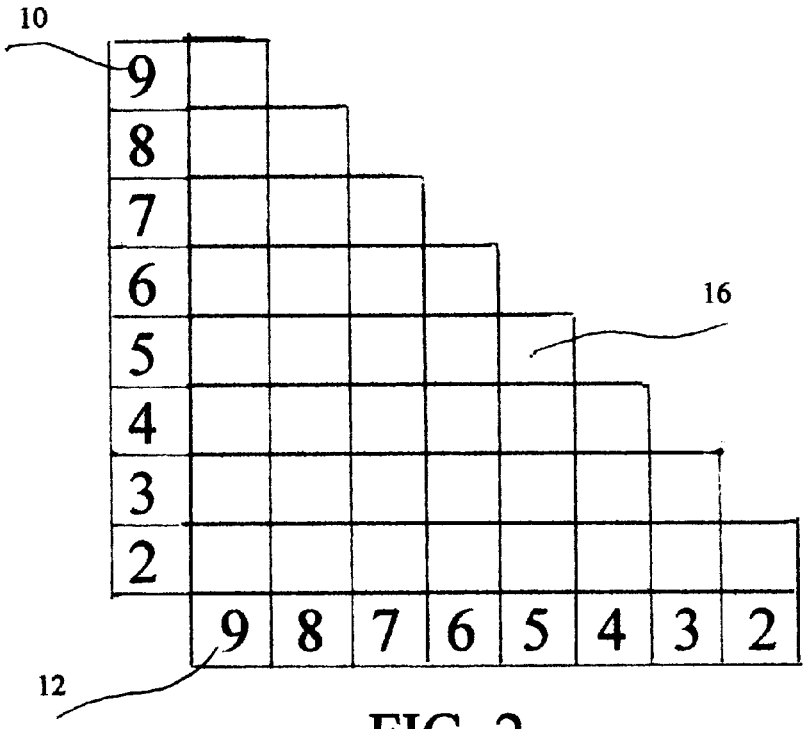
FIG. 2 shows a perspective view of a frame of the simplified table served as a higher-level game board in the game system.

Referring now to the drawings, in which like numerals refer to like parts throughout the several views. FIG. 1 shows a perspective view of a simplified table having 8 numbers in the first column 10, 8 numbers in the last row 12, and 36 numbers in the 36 boxes 14. The numbers in the boxes 14 are the end results of multiplication of the numbers in the column 10 by the numbers in the row 12. When the table in FIG. 1 serves as a game board, players are able to see the numbers when playing the matching game. FIG. 2 shows a perspective view of a frame of the table as shown in FIG. 1, in which all boxes 16 are blank. In this case, players are not provided with any number on the game board for playing the matching game.

The game boards as shown in FIG. 1 and FIG. 2 are preferably made out of plastic material, wood, paper or any solid material. To be more convenient, these boards can be engraved onto the covers of a box. The full board as shown in FIG. 1 can be made into something easily hung on a wall for the purpose of a reminder or decoration, or into any forms of souvenir. The blank board as shown in FIG. 2 can be made into exercise books for the purposes of learning, reconstructing, and testing. The game board FIG. 1 can be used and played in the environment of a playground setting.

Figure 3:
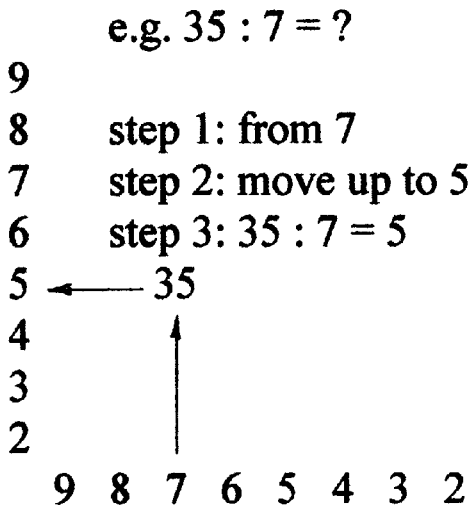
FIG. 3 illustrates an example of application of the simplified table for exact division.
Figure 4:
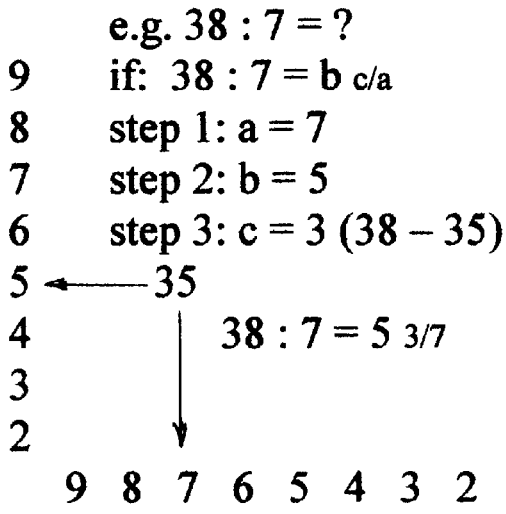
FIG. 4 illustrates an example of application of the simplified table for division with remainder.

Referring now to FIGS. 3 and 4, there are shown two examples of application of the simplified table as shown in FIG. 1. With the simplified version of a multiplication table, the application expanding into division is made obvious and convenient. The extended applications serve important tools and vehicles for players to play, fully and freely, the matching game with the blank game board as shown in FIG. 2.

Figure 5:
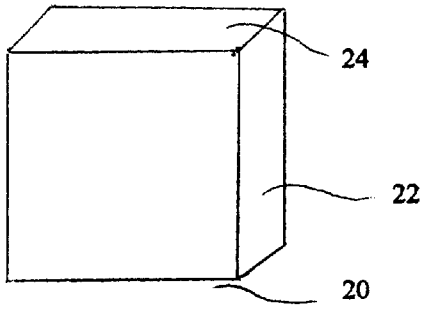
FIG. 5 shows a perspective view of a tile.
Figure 6A:
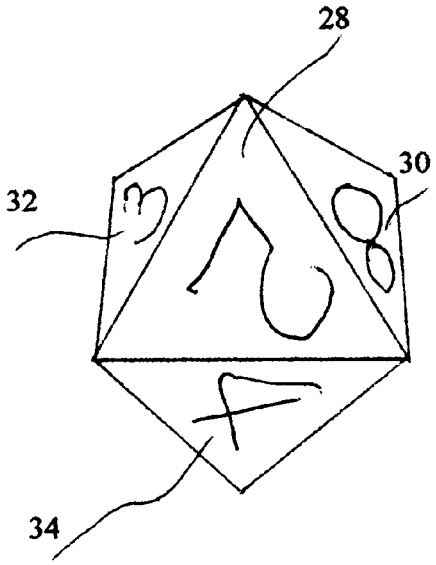
FIGS. 6A to 6D show a perspective view of an eight-sided dice used to determine the matching numbers in the game system.
Figure 6B:
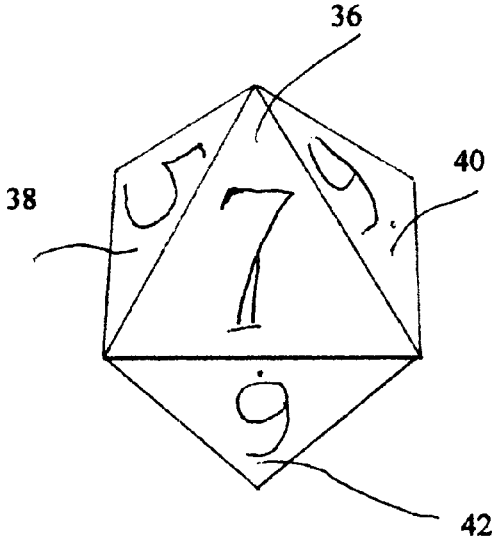
Figure 6C:
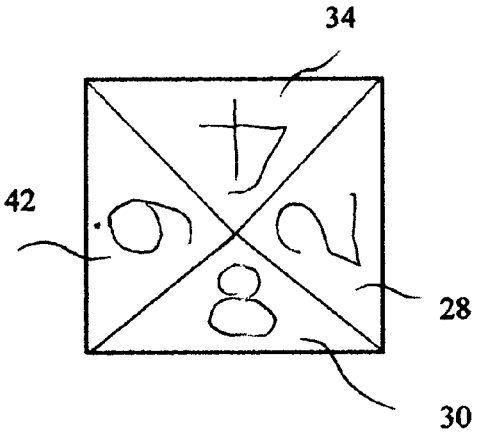
Figure 6D:
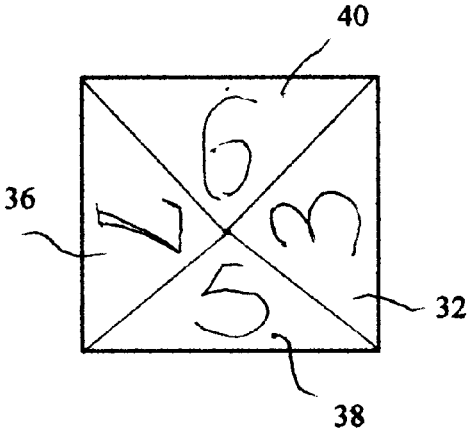

Referring now to FIG. 5, there is shown a perspective view of a tile 18, having a top 20 and a flat bottom 22. There are 36 tiles in the game system. The tiles are preferably made out of plastic material, wood or any solid material.

Referring now to FIGS. 6A to 6D, there is shown a different view of the 8-number dice from different angles, each having a view of a layout of 4 numbers. The 8-plane dice has a total of 8 numbers from 2 (28), 3 (32), 4 (34), 5 (38), 6 (42), 7 (36), 8 (30), and 9 (40), each of which being on an equilateral triangle. For a more round-shape look, each angle of the triangles may be cut. In the game system, two dices are used to determine two numbers from the column 10 and row 12, which in turn determine the corresponding matching number on the box (e.g. if the two numbers determined by the dices are 3 and 7 respectively, the number in the corresponding box will be 21). The dice is preferably made out of plastic material, wood or any solid material.

From the description above, a number of advantages of the present invention with 36 playing pieces, two game boards, and two 8-number dices become evident:

(a) The simplified table will provide a scientific and logical base for an interesting and challenging math game.

(b) The simplified table will open up an easy and convenient excess to memorizing for future users. The physical structure of the simplified table provides players with visible convenience to handle the most difficult part to the table first. Looking at the simplified table, players would interestingly discover a well-organized $2^{nd}$ column: the numbers of tens running from "8" to "1" down, and the numbers of singles from "8" to "1" up. Players could take no time to remember the whole column.

(c) With the use of the simplified table, math educators will have a simple and useful tool for the teaching of the math basics.

(d) The simplified table is designed in such a convenient way that its reconstruction among users will be simple and encouraging.

(e) The expansion of applications will be a great help for the process of mental training.

(f) The two dices will be helpful and convenient among users to carry for the purposes of learning and entertaining.

OPERATION—FIGS. 1, 2, 3, 4, 5, 6

The simplified table can be used as a game board or application expansion into the field of division. As shown in FIG. 1, the construction of the simplified table is very well organized. Simple skill in addition is enough to reconstruct this table. The first column and last row are logically designed: from top to down and left to right. In the second column, the single-digit numbers from 8 to 1 are distributed from bottom up while the double-digit numbers from 8 to 1 are from top down. By subtracting the numbers in the first column from numbers in the second column, one can get the numbers of the third column The reason by analogy can be applied to other numbers in the rest of the columns.

In addition, the first column can be used to train beginners to get rid of the habit of counting with fingers or actual objects. In case of addition, move steps upward, and downward when subtraction is required. For example, the addition of 3 to 2 can be like this: moving up 2 steps up from the number next to 3 (step 1: 4; step 2: 5). By the same token, to subtract 2 from 5, one can simply move 2 steps down from the number next to 5 (step 1: 4; step 2: 3).

FIG. 1 and FIG. 2 can be used as math game boards for different purposes and academic levels. The board as shown in FIG. 1 will be helpful for math beginners to learn the relations between different numbers and the basic concepts of multiplication and division through the interesting math game. The master of these relations and concepts can help strengthening their concepts and skills of addition and subtraction, and building up a solid base for a future learning of math concepts and skills they need in school and life. Players can use the two 8-plane dices to decide the numbers for the column 10 and the row 12, and match these numbers on the tiles in possession to the numbers on the game board. When challenge is needed, players can play the match without the numbers on the boxes 16 of the game board as shown in FIG. 2.

FIG. 5 shows one of the 36 tiles. When playing, players (2 to 4) choose one set of 9 tiles. Whoever finishes the 9 pieces first wins the game.

FIGS. 6A to 6D show different views of an active playing dice, capable of directing the game. There is one number on each of the eight planes. By rolling, the two dices work together to decide two numbers from the column 10 and row 12. In addition, the dices can be used for playing without the game board to challenge a quick response orally.

FIG. 3 and FIG. 4 show two additional applications of the simplified table in exact division and division with remainder. The concept of the division is built on the concepts and integration of addition, subtraction and multiplication. The three-step solution for division with remainder will be a great help for beginners learning the field of division. With the application expanding to the division with remainder, the simplified table has become a complete and convenient tool to ling together all four basic concepts of math: addition, subtraction, multiplication, and division.

Conclusion, Ramification, and Scope

Accordingly, the reader will see that the simplified table and the 8-plane dice can be used to integrate all four concepts of addition, subtraction, multiplication, and division, into learning, testing, and game entertaining. In addition, they provide a convenient tool for parents and educators alike to give the math teaching and learning with some joy and entertaining. Furthermore, the simplified table and the 8-plane dice have the additional advantages in that

- it provides a great environment for a challenging math game;
- it permits an easy and creative understanding and reconstruction;
- it integrates all four basic math concepts, addition, subtraction, multiplication, and division, into daily math practices, teaching, and entertaining,
- it allows an active participation in the learning process of basic math.

Although the present invention has been described in considerable detail with reference to certain embodiment thereof, other versions are possible. For example, the tiles can be replaced by cards and other physical formats. In addition, the tiles in electronic formats are possible for single player to play against computers for self learning or gambling purposes. Furthermore, the 8-number dices can be used for other educational and entertaining purposes. It is understood to those skilled in the art that the playing rules can be altered to meet individual players' need and various gaming purposes. Therefore, the spirit and scope of the appended claims should not be limited to the description of the preferred embodiment contained herein.

What is claimed is:

1. A multiplication capturing and recapturing game, comprising:

two game boards each having thirty-six squares arranged in a grid of rows and columns in the shape of equilateral triangle such that eight squares are arranged along each equilateral edge of the grid;

one of said game boards with a number in each said squares, the other of said game boards having blank squares without any numbers in said squares;

each of the eight squares along each of the equilateral edges of the grid on each board hating a sequential number from two to nine associated therewith and arranged such that, when arranged in a direction from a ninety degree corner of the grid on a board to a forty-five degree corner, the numbers along one equilateral edge are in ascending order from two to nine and the numbers along the other equilateral edge are arranged in descending order from nine to two; further comprising thirty-six playing pieces and a pair of eight-sided dice with numbers from nine to two corresponding to the numbers arranged along one of the equilateral edges on the game boards wherein one die is used as the mulitplier and the other is the multiplicand in the play of the game.

* * * * *